United States Patent [19]

Oguro

[11] 4,220,841

[45] Sep. 2, 1980

[54] MICROWAVE GENERATING DEVICE UTILIZING A MAGNETRON

[75] Inventor: Tomokatsu Oguro, Mobara, Japan

[73] Assignee: Hitachi, Ltd., Tokyo, Japan

[21] Appl. No.: 931,019

[22] Filed: Aug. 4, 1978

Related U.S. Application Data

[63] Continuation of Ser. No. 718,001, Aug. 26, 1976, abandoned.

[30] Foreign Application Priority Data

Nov. 7, 1975 [JP] Japan ..... 50-133088

[51] Int. Cl.[3] ..... H05B 6/68

[52] U.S. Cl. ..... 219/10.55 B

[58] Field of Search ..... 219/10.55 R, 10.55 B; 307/117

[56] References Cited

U.S. PATENT DOCUMENTS

| | | | |
|---|---|---|---|
| 3,693,060 | 9/1972 | Joyce | 307/117 |
| 3,824,365 | 7/1974 | Tapper | 219/10.55 B |
| 3,872,277 | 3/1975 | Niv | 219/10.55 B |

*Primary Examiner*—Arthur T. Grimley
*Attorney, Agent, or Firm*—Charles E. Pfund

[57] ABSTRACT

In a microwave generating device utilizing a magnetron a switching element is connected in the circuit of the cathode heater of the magnetron and ON/OFF-controlled at a predetermined frequency for varying the high frequency output of the microwave generating device.

7 Claims, 5 Drawing Figures

MICROWAVE GENERATING DEVICE UTILIZING A MAGNETRON

This is a continuation of application Ser. No. 718,001 filed Aug. 26, 1976, now abandoned.

BACKGROUND OF THE INVENTION

This invention relates to a microwave generating device utilizing a magnetron and for example, applicable to a high frequency heating apparatus.

Since magnetrons can generate high frequency outputs at high efficiencies, they are used extensively in microwave ranges, defrosting apparatus etc. for heating, drying or cooking. When cooking frozen foodstuffs or eggs in a microwave oven at a high output condition, the foodstuffs often defrost locally or puncture so that it is necessary to variably subject the foodstuffs to the irradiation of high frequency wave depending upon the nature and shape of the foodstuff.

FIG. 1 shows a typical prior art microwave generating device utilizing a magnetron comprising input terminals 11*a* and 11*b* adapted to be connected to a commercial source having a frequency of 50 or 60 Hz and a voltage of 100 V, 117 V or 220 V. These input terminals are connected to the opposite terminals of the primary winding 13*a* of a source transformer 3 via a switch 12. On the secondary side of the source transformer 3 are provided a low voltage winding 13*b* for producing a low voltage of the order of 3.15 V to 4.6 V, for example, and a high voltage winding 13*c* for producing a high voltage of the order of 3 to 4 KV. The low voltage winding 13*b* is connected to the cathode heater or filament 14*a* of a magnetron 14 whereas the high voltage winding 13*c* is connected to a rectifier circuit 17 comprising capacitor 15 and a diode 16. The positive output terminal of the rectifier circuit 17 is connected to the anode electrode 14*b* of the magnetron 14 whereas the negative output terminal is connected to the cathode heater 14*a*. The anode electrode 14*b*, specifically an antenna (not shown) connected to the anode electrode is connected to a high frequency heating apparatus not shown.

When switch 12 is closed to excite the primary winding 13*a* predetermined low and high voltages are induced in the low voltage winding 13*b* and the high voltage winding 13*c* on the secondary side. The output from the low voltage winding 13*b* heats the cathode heater 14*a* of the magnetron, whereas the output from the high voltage winding 13*c* is rectified by the rectifier circuit 17, the output DC voltage thereof is impressed across the anode and cathode electrodes of the magnetron. Then the magnetron oscillates at a high frequency and supplies its high frequency outputs to a heating apparatus. Consequently, the molecules of the substance to be heated undergo polarization thus rotating at a speed of 2,450,000,000 revolutions per second. The resulting frictional heat is used to heat the substance to be heated. In one example, when the cathode is heated by an AC power of 3.15 V$\times$14 amperes and a DC input of 4 KV$\times$0.3 A is applied across the anode and cathode electrodes a high frequency output of about 600 to 700 W will be produced.

When such high output is used to defrost frozen foodstuffs or to cook eggs the power is surplus. For example, in the case of defrosting, the foodstuff melts locally to form water and since the high frequency power concentrates to such portions it is difficult to defrost uniformly.

When cooking an egg, the inside temperature rises quickly thus rupturing the egg.

To solve these problems, it has been proposed a magnetron oscillator wherein the switch 12 connected between the input terminal 11*b* and the primary winding 13*a* of the source transformer 3 is periodically opened and closed with a period T for varying the high frequency output of the magnetron 14. Thus, when the switch 12 is closed for $\tau$ second and opened for $(T-\tau)$ second and when such closing and opening operation is repeated, the average oscillation output of the magnetron varies in proportion to the duty ratio $\tau/T$. For example, when the switch 12 is closed at a duty ratio of $\frac{1}{3}$ it is possible to obtain a high frequency output of about 200 W. In this manner any desired output suitable for the nature and shape of the substance being heated can be obtained by varying the duty ratio of the switch 12.

When such magnetron oscillator is used to defrost a frozen foodstuff or to cook an egg, as it is possible to preheat the foodstuff with a relatively low output of the order of about 200 W, it is possible to eliminate the problems of uneven heating and the rupture of the foodstuff being cooked. However, as the switch 12 intermittently interrupts a power of 100 V$\times$12 A=1.2 KW at a duty ratio of $\frac{1}{3}$, it is necessary to use a relay having a large interrupting capacity or a thyristor having a large capacity as the switch 12 thus increasing the size and cost thereof. Another solution of this problem is shown in FIG. 2 wherein a switch 18 is interposed between the high voltage secondary winding 13*c* and the rectifier circuit 17. In this microwave generating device, switch 12 is firstly closed to heat the cathode heater 14 and then the switch 18 is controlled in the same manner as above described to vary the high frequency output in accordance with the nature and shape of the foodstuff to be heated.

However, when the microwave generating device utilizing a magnetron shown in FIG. 2 is used as a high frequency heating apparatus to defrost a frozen foodstuff or to cook an egg, although the same advantages effect as that shown in FIG. 1 can be obtained, as the switch 18 interrupts a power of 4 KV$\times$0.3 A=1.2 KW the switch 18 is required to have a breakdown voltage of higher than 4 KV thus increasing the size and cost than those of switch 12. In addition, as a high voltage circuit including the large inductance of the transformer winding is opened and closed periodically, there is a tendency of forming a surge. Moreover, insulation for switch 18 must be strengthened. As the voltage is high it is difficult or impossible to use a semiconductor switching element. Accordingly, the circuit shown in FIG. 2 is comparable with the circuit shown in FIG. 1.

SUMMARY OF THE INVENTION

It is an object of this invention to provide an improved microwave generating device utilizing a magnetron which is applicable to a high frequency heating apparatus in which the high frequency output can be readily controlled.

Another object of this invention is to provide a microwave generating device utilizing a magnetron which is capable of varying the high frequency output with a switch having a small size and a small capacity.

Still another object of this invention is to provide a novel microwave generating device utilizing a magnetron which is capable of readily controlling the high frequency output for the purpose of obtaining a desired temperature for defrosting frozen foodstuffs.

According to this invention, these objects can be accomplished by providing a microwave generating device utilizing a magnetron which is applicable to a high frequency heating apparatus wherein a switching element is connected in the circuit of the cathode heater of the magnetron and control means is provided for causing the switching element to close at a predetermined duty ratio thereby varying the high frequency power output of the microwave generating device.

BRIEF DESCRIPTION OF THE DRAWINGS

In the accompanying drawings

DESCRIPTION OF THE PREFERRED EMBODIMENTS

Figure 1:
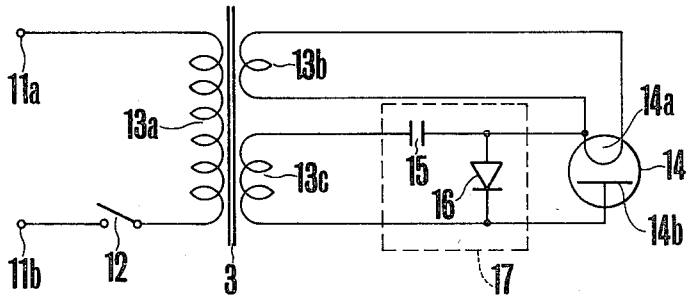
FIG. 1 PRIOR ART
FIGS. 1 and 2 show connection diagrams of two types of the prior art microwave generating device utilizing a magnetron.
Figure 2:
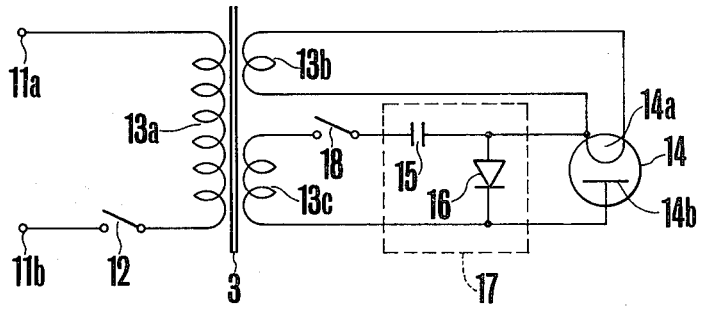
FIG. 2 PRIOR ART
Figure 3:
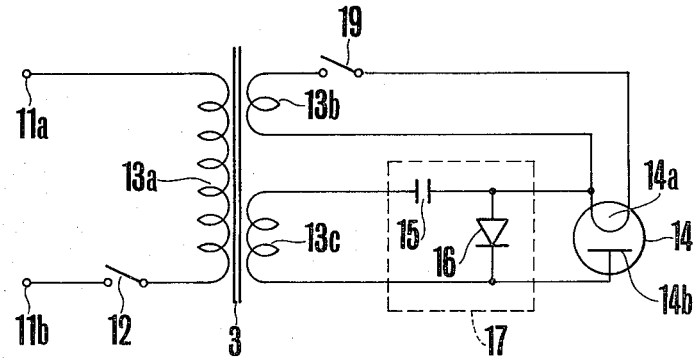
FIG. 3 is a connection diagram of an improved microwave generating device utilizing a magnetron embodying the invention.

In a preferred embodiment of this invention shown in FIG. 3, the circuit elements corresponding to those shown in FIGS. 1 and 2 are designated by the same reference numerals. According to this invention, a switch 19 provided with a control member, not shown, is connected between the low voltage secondary winding 13*b* and the cathode heater 14*a* of the magnetron.

In operation, when switch 12 is closed, the voltage induced in the high voltage secondary winding 13*c* is rectified by the rectifier circuit 17 and its high output DC voltage is impressed across the anode and cathode electrodes of the magnetron 14. The low voltage induced in the low voltage secondary winding and applied across the cathode heater is controlled by switch 19. Then, the magnetron produces a high frequency output only when its cathode electrode is heated by the closure of switch 19. The switch 19 is constructed to vary its duty ratio and the period of operation by the control member, not shown. Thus, it is possible to produce a desired high frequency output by varying the duty ratio of the switch in accordance with the nature and shape of the foodstuff to be heated.

Figure 4:
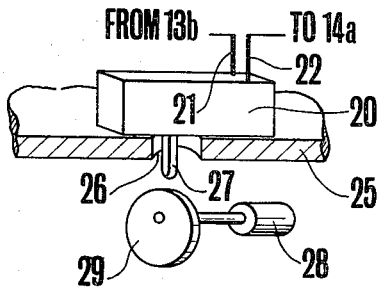
FIGS. 4 and 5 show two examples of the switches utilizing in this invention.
Figure 5:
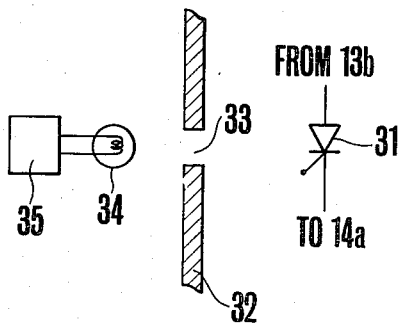

FIG. 4 shows one example of the switch 19 utilized in this invention which comprises a microswitch 20 having terminals 21 and 22 respectively connected to the low voltage secondary winding 13*b* and the cathode heater 14*a* of the magnetron. The microswitch 20 is mounted on an insulating support 25 having an opening 26 through which an operating member 27 extends downwardly. The operating member 27 is positioned to be operated by a insulating cam 29 driven by a motor 28. A stirrer motor of the high frequency heating apparatus or a fan motor for cooling the magnetron can be used to drive the cam 29 which is shaped to interrupt the high frequency output at a desired duty ratio. Since the switch 19 interrupts only a small power of 3.15 V×14 A=44 W, for example, it is possible to provide the desired duty control with much smaller switching power than the prior art magnetron oscillator, thus producing any desired high frequency output. Thus, the switch 19 may be extremely small, low cost and having a small capacity. Further, even when the filament current is intermittently interrupted, the cathode temperature does not vary quickly with the result that the magnetron output varies more slowly than the prior art device which is suitable for defrozing frozen foodstuffs and for cooking eggs. It will be clear that a semiconductor switching element can be used as switch 19. FIG. 5 shows one example of the modification using such semiconductor switching element in the form of a light activated silicon controlled rectifier or SCR 31. The anode electrode of SCR 31 is connected to the low voltage secondary winding 13*b* while the cathode electrode is connected to the cathode heater of the magnetron. The SCR 31 is disposed to receive the light from a source of light such as a lamp or a light emitting diode 34 through a perforation 33 of an insulating plate 32. The light source 34 is connected to a control circuit 35 which causes the light source to flicker at a predetermined duty cycle. The control circuit 35 comprised a well known blocking oscillator or a chopper which is constructed to manually vary the flickering cycle of the light source. This modification is advantagous in that the SCR 31 can be insulated from the control circuit.

In the above embodiment, though the SCR 31 receives the light from the light source 34 through the perforations 33 of the insulating plate 32, the SCR31 may receive the light from the light source 34 directly without any intermediate medium. The SCR may be substituted by a well known photoelectric element, such as a photodiode, a photocell or a phototransistor. The construction can be simplified by using a photocoupler.

As above described according to this invention, the current flowing through the cathode heater of a magnetron is interrupted at a predetermined period for varying the high frequency output of the microwave generating device which is used to heat a substance. Thus, as the circuit for the cathode heater is interrupted it is possible to use a simple switch or a low voltage thyristor having smaller interrupting capacity than switches 12 and 15 which have been used to interrupt the primary side or the high voltage secondary side of the source transformer. As a consequence, it is possible to use a small and cheap switching element. Where a photosensitive semiconductor element is used the problem of the breakdown voltage can be eliminated.

What is claimed is:

1. In a microwave generating device providing a high frequency power output for production of heat utilizing a magnetron having a directly heated cathode filament, and including a transformer having a secondary winding connected in series with said cathode filament for providing a flow of current to the cathode filament to provide heating power thereto, the improvement which comprises a switching element connected in series with the transformer secondary winding and the cathode filament of the magnetron, and means for causing said switching element to intermittently interrupt the current flowing from the secondary winding through the cathode filament without quickly varying the cathode temperature, the intermittent interruption determining the duty ratio of said current flowing to said filament to be less than continuous current flow thereby decreasing average heating current to said filament and thereby varying the high frequency power output of said microwave generating device.

2. The microwave generating device utilizing a magnetron according to claim 1 wherein said switching element comprises a microswitch and said means comprises a motor and a rotary cam attached to said motor and in operable contact with said microswitch to cause said microswitch to close and open in response to the rotation of said motor and said cam.

3. The microwave generating device utilizing a magnetron according to claim 2 wherein said microswitch has an actuating member and said microswitch is mounted on an insulating plate provided with a perforation such that the actuating member of the microswitch extends through said perforation to be operated by said rotary cam.

4. The microwave generating device utilizing a magnetron according to claim 1 wherein said switching element comprises a photoelectric element responsive to illumination thereof to control said current flowing to said filament; and wherein said means for causing comprises a light source for providing illumination of said photoelectric element in response to an electric signal applied thereto, and control means for applying an electric signal to said light source to cause said light source to flicker and intermittently illuminate said photoelectric element at a predetermined rate and duty cycle.

5. The microwave generating device utilizing a magnetron according to claim 4 wherein said photoelectric element comprises a light activated silicon controlled rectifier connected in series with the cathode filament of the magnetron.

6. The microwave generating device utilizing a magnetron according to claim 5 wherein said silicon controlled rectifier is disposed to receive the light from the light source, and said light source is caused to flicker at a predetermined duty cycle by said control means.

7. The microwave generating device utilizing a magnetron according to claim 6 wherein said silicon controlled rectifier receives the light from a light source through a perforation of an insulating plate.

* * * * *